US005718641A

United States Patent [19]

Lin

[11] Patent Number: 5,718,641

[45] Date of Patent: Feb. 17, 1998

[54] GOLF CLUB HEAD THAT MAKES A SOUND WHEN STRIKING THE BALL

[75] Inventor: Chih Ming Lin, Kaohsiung, Taiwan

[73] Assignee: Ae Teh Shen Co., Ltd., Kaoshiung, Taiwan

[21] Appl. No.: 826,186

[22] Filed: Mar. 27, 1997

[51] Int. Cl.[6] ..... A63B 53/04; A63B 69/36

[52] U.S. Cl. ..... 473/224; 473/345; 473/346

[58] Field of Search ..... 473/219, 223, 473/224, 226, 233, 234, 256, 282, 290, 291, 324, 332, 345, 346; 446/397, 404, 422, 418; 434/252

[56] References Cited

U.S. PATENT DOCUMENTS

| | | | |
|---|---|---|---|
| 479,636 | 7/1892 | Droop | 446/422 |
| 1,549,350 | 8/1925 | Deike | 473/234 |
| 3,556,532 | 1/1971 | Ballmer | 473/332 |
| 3,695,618 | 10/1972 | Woolley | 473/342 |
| 4,017,083 | 4/1977 | Johnson | 473/231 |
| 4,191,378 | 3/1980 | Morin et al. | 473/224 |
| 4,432,549 | 2/1984 | Zebelean | 473/345 |
| 4,438,931 | 3/1984 | Motomiya | 473/346 |
| 4,461,481 | 7/1984 | Kim | 473/333 |
| 4,511,145 | 4/1985 | Schmidt | 473/346 |
| 4,840,371 | 6/1989 | Harris | 473/346 |
| 5,000,454 | 3/1991 | Soda | 473/346 |

*Primary Examiner*—Sebastiano Passaniti
*Attorney, Agent, or Firm*—Pro-Techtor International

[57] ABSTRACT

A golf club head having a perforated sound plate suspending inside a hollow casing thereof, the perforated sound plate being vibrated to make a sound when the golf club head strikes the ball.

3 Claims, 3 Drawing Sheets

GOLF CLUB HEAD THAT MAKES A SOUND WHEN STRIKING THE BALL

BACKGROUND OF THE INVENTION

The present invention relates to golf club heads, and more particularly to such a golf club head which makes a sound when striking the ball.

The game of golf has become more and more popularly accepted by adults. When playing the game of golf, a set of golf clubs shall be used. The club head of a regular golf club is made hollow so that it makes a sound to spirit the player up when striking the ball. However, because the level of the sound is low, it cannot be clearly heard.

SUMMARY OF THE INVENTION

The present invention has been accomplished under the circumstances in view. It is the main object of the present invention to provide a golf club head that makes a sound and echoes the sound when striking the ball.

DETAILED DESCRIPTION OF THE PREFERRED EMBODIMENT

Figure 1:
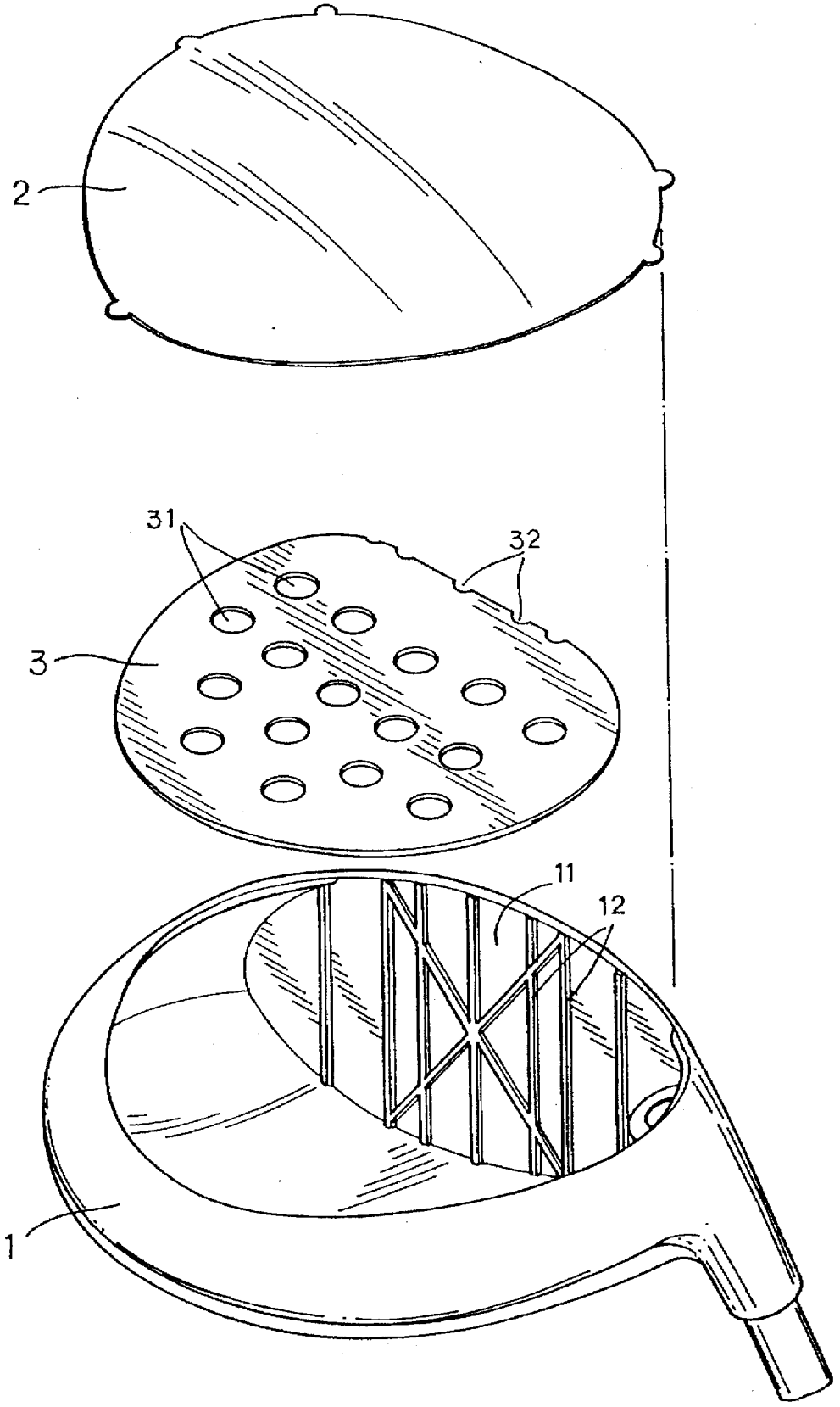
FIG. 1 is an exploded view of a golf club head according to the present invention.
Figure 2:
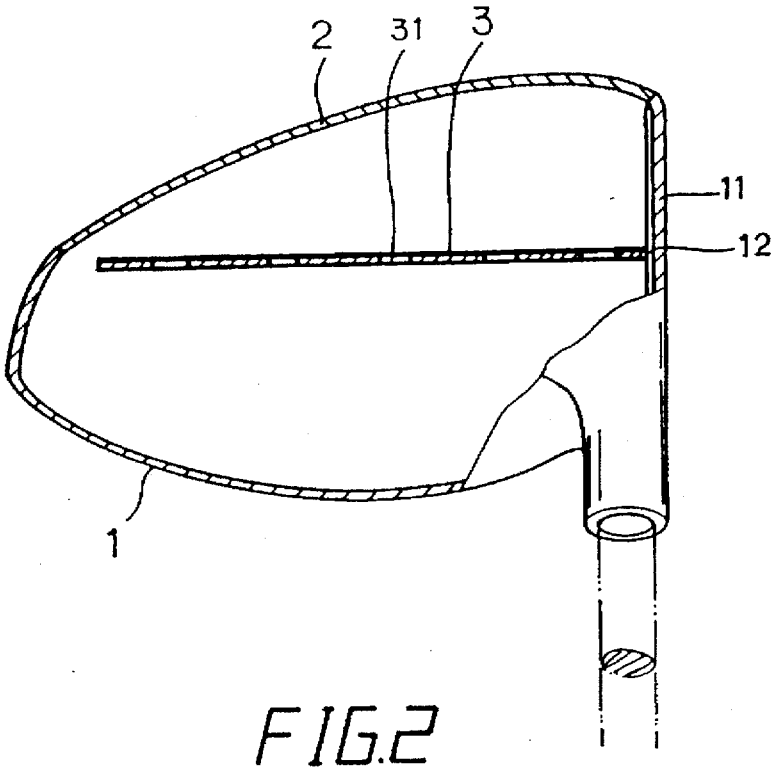
FIG. 2 is a sectional view of the present invention, showing the sound plate welded to the face panel inside the casing.

Referring to FIGS. 1 and 2, a golf club head in accordance with the present invention is generally comprised of a casing 1, a sole plate 2, and a sound plate 3. The sound plate includes one edge fixedly attached to an inside portion of the hollow casing and extends away from this edge into the hollow casing with remaining edges of the sound plate being unattached to the inside portion of the hollow casing.

The casing 1 is a hollow shell having a face panel 11 made in integrity and reinforced with ribs 12. The sole plate 2 is welded to the casing 1 and covered on its hollow bottom side. The sound plate 3 is a flat plate having a notched side edge 32 fitting over the ribs 12 and perpendicularly welded to the back side of the face panel 11, and a plurality of through holes 31. When the sound plate 3 is installed, it is disposed perpendicular to the face panel 11.

Figure 4:
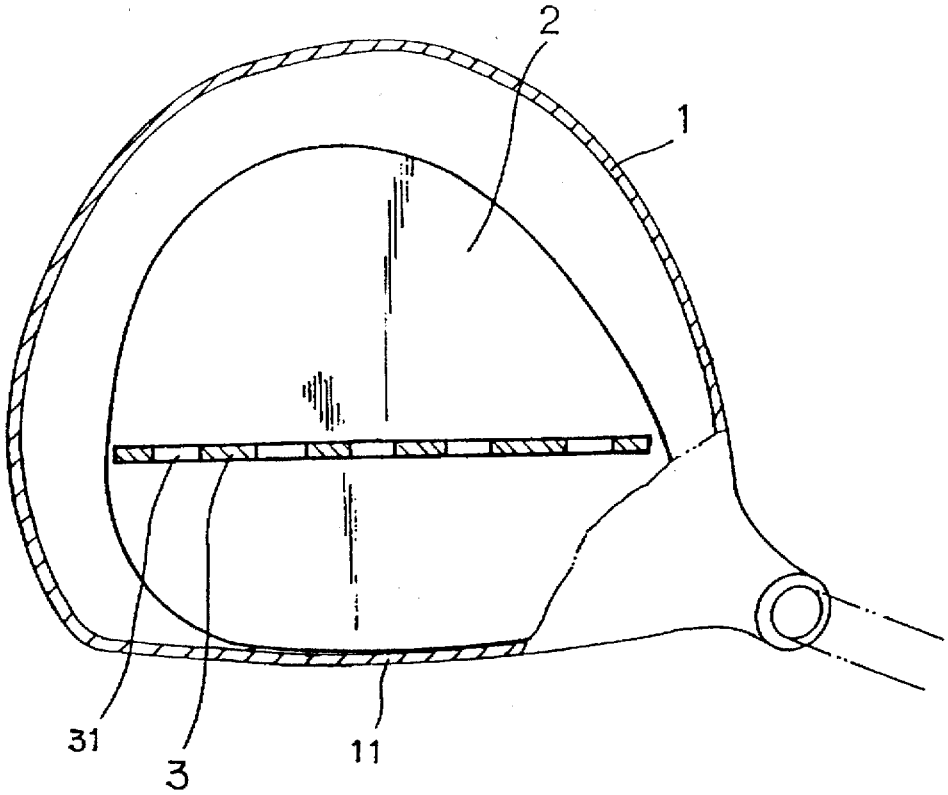
FIG. 4 is a sectional assembly view of the alternate form shown in FIG. 3.
Figure 3:
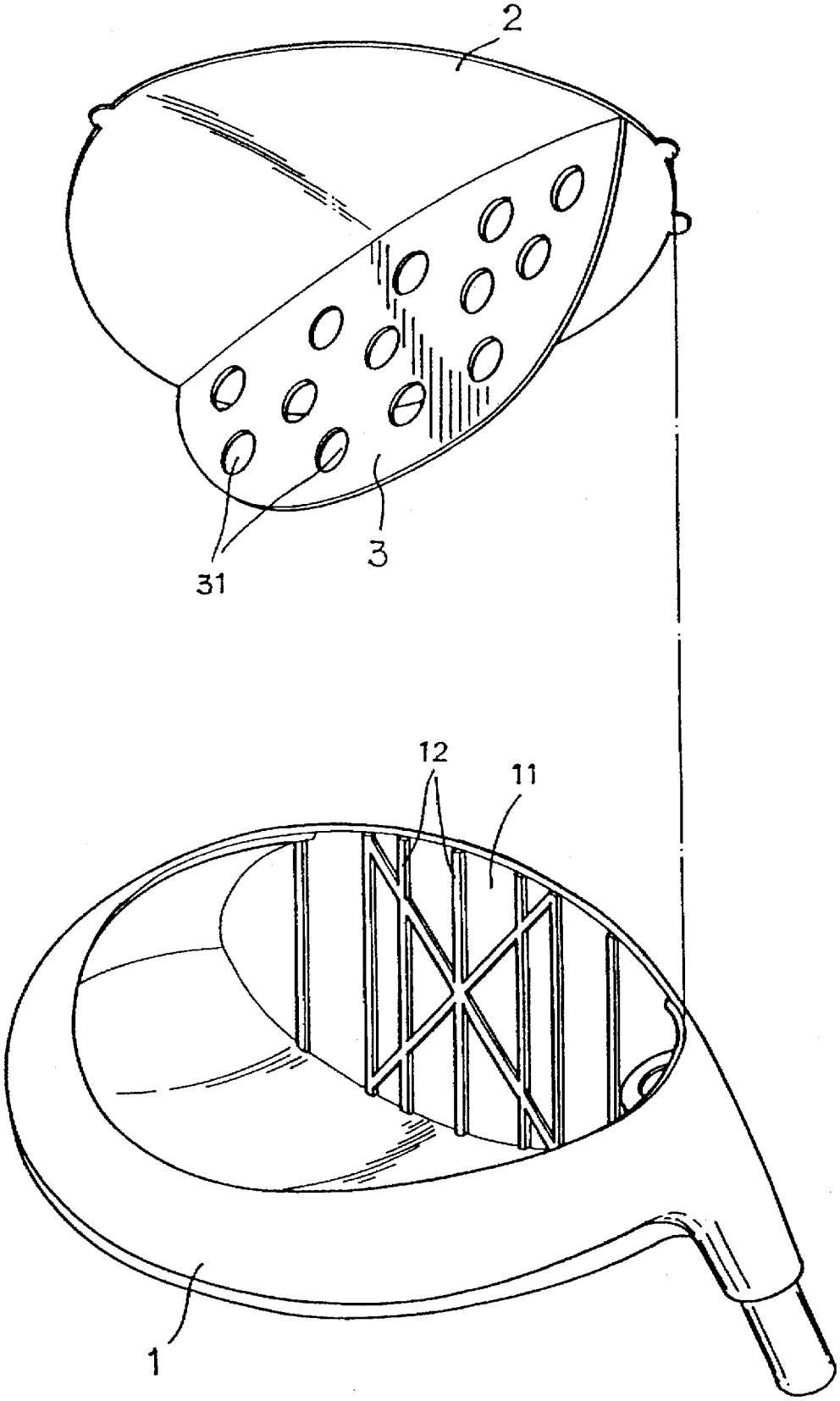
FIG. 3 is an exploded view of an alternate form of the present invention.

As an alternate form of the present invention, the sound plate 3 can be welded to the sole plate 2 and retained in parallel to the face panel 11 of the casing 1 (see FIGS. 3 and 4).

Because the sound plate 3 is suspended in the casing 1, it is vibrated to make a sound when the face panel 11 strikes the ball, and the sound will be echoed through the inside chamber of the casing 1.

It is to be understood that the drawings are designed for purposes of illustration only, and are not intended as a definition of the limits and scope of the invention disclosed.

What the invention claimed is:

1. A golf club head comprising a hollow casing having a face panel reinforced with back ribs and a bottom opening, a sole plate welded to said casing and for covering said bottom opening, a perforated, generally flat sound plate having one edge fixedly attached to an inside portion of said hollow casing and extending away from said one edge into said hollow casing with remaining edges of said sound plate being unattached to said inside portion of said hollow casing, wherein said perforated sound plate is suspended inside said casing and vibrated to make a sound when said face panel strikes a golf ball.

2. The golf club head of claim 1 where said perforated sound plate is perpendicularly welded to said face panel, having a notched side edge welded to said face panel and fitting over the back ribs of said face panel.

3. The golf club head of claim 1 wherein said perforated sound plate is welded to said sole plate and disposed in parallel arrangement to said face panel.

* * * * *